United States Patent [19]

Sequeira, Jr.

[11] Patent Number: 5,041,206

[45] Date of Patent: Aug. 20, 1991

[54] SOLVENT EXTRACTION OF LUBRICATING OILS

[75] Inventor: Avilino Sequeira, Jr., Port Arthur, Tex.

[73] Assignee: Texaco Inc., White Plains, N.Y.

[21] Appl. No.: 439,220

[22] Filed: Nov. 20, 1989

[51] Int. Cl.[5] ..... C10G 21/00

[52] U.S. Cl. ..... 208/87; 208/36; 208/311; 208/317; 208/320

[58] Field of Search ..... 208/317, 322, 327, 331, 208/332, 87, 330, 311, 335; 585/865, 833

[56] References Cited

U.S. PATENT DOCUMENTS

| | | | |
|---|---|---|---|
| 2,261,799 | 11/1941 | Franklin, Jr. | 208/321 |
| 2,281,257 | 4/1942 | Benedict et al. | 208/87 |
| 2,748,055 | 5/1956 | Payne | 208/87 |
| 2,902,443 | 9/1959 | Wadley | 208/87 |
| 3,053,759 | 9/1962 | Harvey | 208/87 |
| 3,232,863 | 2/1966 | Watson et al. | 208/87 |
| 3,501,398 | 3/1970 | Menzl et al. | 208/335 |
| 3,501,399 | 3/1970 | Menzl et al. | 208/317 |
| 3,539,504 | 11/1970 | Cummins | 208/327 |
| 3,654,137 | 4/1972 | Dober et al. | 208/87 |
| 3,691,061 | 9/1972 | Koch | 208/87 |
| 3,696,023 | 10/1972 | Koch | 208/87 |
| 3,828,489 | 7/1974 | Steimentz et al. | 208/327 |
| 3,912,618 | 10/1975 | Dryer | 208/327 |
| 4,304,660 | 12/1981 | Sequeira et al. | 208/326 |
| 4,328,092 | 5/1982 | Sequeira et al. | 208/326 |
| 4,428,829 | 1/1984 | Kosters | 208/317 |
| 4,564,440 | 1/1986 | Garwood et al. | 208/87 |
| 4,755,279 | 7/1988 | Unmuth et al. | 208/87 |
| 4,764,265 | 8/1988 | Bijwaard et al. | 208/87 |

*Primary Examiner*—Helane E. Myers

*Attorney, Agent, or Firm*—Jack H. Park; Kenneth R. Priem; Richard A. Morgan

[57] ABSTRACT

A lubricating oil stock is extracted with N-methyl-2-pyrrolidone to yield a primary raffinate useful as a high VI lubricating base oil and a primary extract. The primary extract is mixed with antisolvent and chilled to yield a secondary raffinate. This secondary raffinate is sufficiently reduced in aromatics that it is suitable for fluidized catalytic cracking in the absence of hydrogenation.

24 Claims, 1 Drawing Sheet

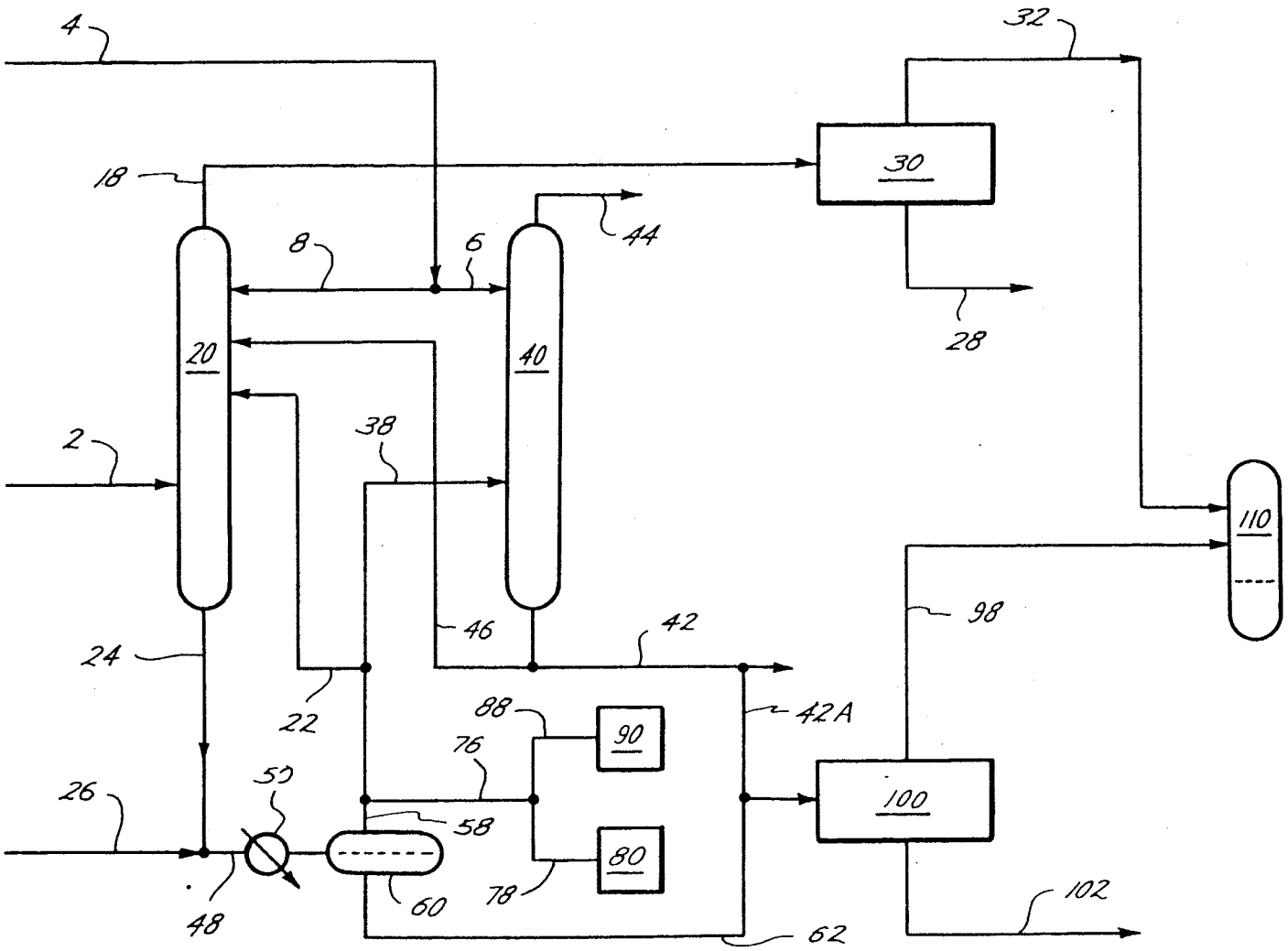
110
32
30
28
98
100
102
42A
62
42
44
40
90
80
88
78
76
58
60
6
46
38
8
22
50
48
20
18
4
2
24
26

SOLVENT EXTRACTION OF LUBRICATING OILS

BACKGROUND OF THE INVENTION

1. CROSS-REFERENCE TO RELATED APPLICATION

This application is related to application Ser. No. 07/439,219 filed on even date, for Solvent Extraction Of Lubricating Oils by A. Sequeira, Jr.

1. Field Of The Invention

The invention relates to solvent refining a petroleum derived lubricating oil stock to yield aromatics lean raffinates. More particularly the invention relates to producing high viscosity index lubricating oil from one raffinate while producing fluid catalytic cracking feedstock from a second raffinate.

2. Description Of the Related Arts

It is well known in the art to upgrade lubricating oil stocks. Upgrading typically involves treating these stocks with selective solvents to separate a relatively more aromatic fraction from a relatively more paraffinic fraction. In such a treatment, the preferred configuration comprises a countercurrent extraction process in which the lighter lubricating oil phase is introduced into the center or bottom section of the countercurrent extraction tower. The oil phase flows upwardly through the extraction tower and contacts downwardly flowing solvent which is introduced into the upper section of the extraction tower. A relatively paraffinic fraction, termed raffinate, is recovered from the top section of the extraction tower while solvent and relatively aromatic fraction, termed extract, are recovered from the bottom section of the tower.

Multistage solvent extraction processes are also known wherein either the raffinate phase, the extract phase or both are subjected to repeated extraction to enhance a desired property.

Paraffinic stocks have been upgraded by a combination of solvent extraction followed by hydrogenation in the presence of hydrogenation catalyst at temperatures in the order of 650° F. to 850° F. and relatively high hydrogen partial pressures.

A description of such a process is found in U.S. Pat. No. 3,806,445 to H. C. Henry et al. which describes a process for upgrading a paraffinic fraction to increase viscosity index (VI) and improve ultraviolet (UV) light stability. In the process a lubricating oil stock is solvent extracted to remove aromatics and then catalytically cracked in the presence of hydrogen under mild hydrocracking conditions and then extracted a second time.

U.S. Pat. No. 2,305,038 to F. W. Schumacher describes a process for the solvent extraction of mineral oils. In accordance with the process the oil remaining in the extraction solvent is removed by treatment with a relatively higher boiling oil. The mixture is distilled to effect a separation of extraction solvent as an overhead product and oil as a bottoms product.

U.S. Pat. No. 2,261,799 to J. L. Franklin, Jr. describes a process for the solvent extraction of mineral oils and removal of solvent from raffinates. In accordance with the invention, the extracted oil is reextracted with a secondary solvent which has a preferential selectivity for the primary solvent relative to the mineral oil. A raffinate, reduced in solvent is obtained.

U.S. Pat. No. 2,081,721 to W. J. D. Van Dijck et al. describes improvements in a solvent extraction process.

U.S. Pat. No. 4,328,092 to A. Sequeira, Jr. teaches a process for the solvent extraction of hydrocarbon oils.

In the process N-methyl-2-pyrrolidone is the extraction solvent. The hydrocarbon oil is solvent extracted to form two phases, a secondary extract phase and a secondary raffinate phase. The secondary raffinate phase is returned to the extraction zone. As a result, an increased yield of refined oil product and a savings in energy is achieved.

U.S. Pat. No. 4,304,660 to A. Sequeira, Jr. discloses lubricating oils suitable for use as refrigeration oils. Those lubricating oils are produced by solvent extraction of naphthenic lubricating oil base stocks to yield an extract which is mixed with a solvent modifier and cooled to form a secondary raffinate and secondary extract. The secondary raffinate is treated with concentrated sulfuric acid and caustic neutralized to produce the refrigeration oil.

SUMMARY OF THE INVENTION

An improvement has been discovered in a process for solvent refining a petroleum based lubricating oil stock containing aromatic and non-aromatic components. The lubricating oil stock is contacted in an extraction zone with an extraction solvent in a solvent/oil dosage in the range of 75 vol % to 500 vol % at an extraction temperature in the range of 100° F. to 250° F. An aromatics-rich primary extract and an aromatics-lean primary raffinate of increased viscosity index are withdrawn from the extraction zone.

In the improvement, the primary extract is cooled to a temperature 10° F. to 120° F. below the extraction temperature. About 0.0 vol % to 10 vol % preferably 0.5 vol % to 10 vol %, most preferably 3 vol % to 5 vol % antisolvent is added to the primary extract in a separation zone. As a result, two phases are formed consisting of a secondary extract richer in aromatics and a secondary raffinate leaner in aromatics.

The secondary raffinate phase is separated and passed to a fluid catalytic cracking zone at cracking conditions to yield a liquid fuel product. The fluid catalytic cracking is achieved in the absence of prior hydrocracking of the feedstock, the primary raffinate or the secondary raffinate.

DESCRIPTION OF THE DRAWING

Details of the process are disclosed in the accompanying drawing which is a schematic flow diagram illustrating a solvent refining process employing the process of this invention.

With reference to the drawing, a lubricating oil feedstock enters the system through line 2 and is introduced into primary extraction tower 20 wherein it is brought into intimate countercurrent contact with an extraction solvent. The feedstock enters the primary extraction tower 20 at about the middle or below the middle of the tower. Fresh extraction solvent is brought into the process through line 4 and enters the upper portion of primary extraction tower 20 through line 8. Additional recycled solvent may be brought into primary extraction tower 20 from solvent accumulator 110 after water removal (not shown) in accordance with the maintaining solvent inventory balance.

In the primary extraction tower 20, the lubricating oil feedstock is intimately contacted countercurrently with an extraction solvent which has a preferential affinity for aromatic compounds compared to paraffinic compounds. As example of such a solvent is N-methyl-2-pyrrolidone which is used in the commercial petroleum refining industry for this purpose. Extraction solvent is added in an amount relative to the lubricating oil feedstock. On a percentage basis about 75 vol % to 500 vol % solvent is added relative to the lubricating oil feedstock, with a dosage in the range of 100 vol % to 300 vol % being typical. Extraction temperature is broadly in the range of 100° F. to 250° F. and pressure in the range of 0.5 atm to 10 atm.

As a result of the countercurrent contacting at solvent extraction temperatures and pressures an aromatics-lean primary raffinate is passed from the top portion of primary extraction tower 20 through line 18 to primary raffinate recovery system 30. Primary raffinate recovery system 30 comprises any of the processes to remove raffinate from residual solvent. This may include, for example, distillation wherein a solvent free raffinate is distilled as a bottoms product and passed via line 28 to tankage. The overhead product of distillation is passed via line 32 to solvent accumulator 110. Primary raffinate recovery system 30 may alternatively be a second extraction stage wherein the primary raffinate is extracted with a second extraction solvent which is only slightly soluble in mineral oils and which is preferentially selective for the primary solvent as compared to the mineral oil. Such a solvent removal process is described in U.S. Pat. No. 2,261,799 to J. L. Franklin, Jr. incorporated herein by reference.

An aromatics-rich primary extract in solution with extraction solvent is passed from the bottom of primary extraction tower 20 through line 24 and line 48 to primary extract cooler 50. Simultaneously antisolvent such as water or wet extraction solvent is passed in an amount of 0.5 vol % to 10 vol % through line 26 and also line 48 through primary extract cooler 50. Solvent accumulator 110 is a source of wet solvent. Both streams are cooled by means of indirect heat exchange in cooler 50 to a temperature that is 10° F. to 120° F. below the temperature in primary extraction tower 20. The streams are passed together to decanter 60 where two phases spontaneously form. The upper phase is a secondary raffinate phase which is leaner in aromatics than the primary extract. The lower phase is a secondary extract phase which is richer in aromatics and comprises a major proportion of the solvent.

The lower secondary extract phase is passed from decanter 60 through line 62 to extract recovery system 100 which comprises means for separating the aromatics rich extract from extraction solvent. This separation means comprises vacuum flash towers and a stripper. A solvent free aromatic extract is passed through line 102 to tankage for use consistent with its aromaticity. The solvent from the extract recovery system 100 is passed through line 98 to solvent accumulator 110 for retention and reuse in the process.

There are four dispositions which can be made of secondary raffinate phase from decanter 60. The first disposition comprises the invention. The combination of the first disposition with alternate dispositions is dependent on product demand and it is understood that the flexibility of disposition is an attribute of the inventive process which makes it a valuable addition to the useful arts.

In the first disposition secondary raffinate phase is passed via line 58, line 76 and line 88 to solvent recovery (not shown) and to fluid catalytic cracking zone 90. In fluid catalytic cracking zone 90 the secondary raffinate is catalytically cracked in a fluidized catalyst bed at catalytic reaction conditions to liquid fuel boiling range products.

In the second disposition secondary raffinate phase is passed via line 58, line 76 and line 78 to solvent recovery (not shown) and on to lube oil dewaxing zone 80 wherein wax is removed by catalytic dewaxing, by solvent dewaxing or both to yield a lubricating base oil of low to medium viscosity index.

In the third disposition secondary raffinate phase is passed through line 58 and line 22 to the primary extraction tower. As described in U.S. Pat. No. 4,328,092 to A. Sequeira, Jr., the preferred amount is 0.1 to 0.5 volumes of secondary raffinate for each volume of lubricating oil stock supplied to the primary extraction tower via line 2. As a result of this recycle the fresh feed supplied to primary extraction tower 20 through line 8 or the solvent dosage may be reduced to the lower quantities in the specified range and the yield of a raffinate produced via line 28 is increased at constant refractive index.

In the fourth disposition secondary raffinate phase is passed through line 58 and line 38 to secondary extraction tower 40 where the secondary raffinate phase is solvent extracted a second time by countercurrent contacting with extraction solvent via line 4 and line 6 to produce a tertiary raffinate phase via line 44 which after solvent removal is used as lubricating base oil of intermediate viscosity index.

The solvent rich tertiary extract may be returned to primary extraction tower 20 through line 46 to make up a portion of the solvent to the tower. In the alternative this tertiary extract can be passed through line 42 to solvent removal (not shown) and the oil used as fuel or for carbon black manufacture, or passed to extract recovery system 100 via line 42A.

DESCRIPTION OF THE PREFERRED EMBODIMENTS

In accordance with this invention it has been discovered that a petroleum based lubricating oil stock can be economically processed to yield fluid catalytic cracking feedstocks in the absence of hydrocracking or other additional reduction of aromatic content.

Specifically, the process comprises (a) solvent extracting a petroleum derived lubricating oil stock with an extraction solvent having preferential solubility for aromatics and as a result forming a primary extract phase and a primary raffinate phase; (b) cooling the primary raffinate phase and admixing an antisolvent thereby forming a secondary extract phase and a secondary raffinate phase; (c) cracking the secondary raffinate phase in a fluidized catalytic cracking zone to yield a liquid fuel product.

Feedstocks that are suitable for use in the process include hydrocarbons, mixtures of hydrocarbons and particularly, hydrocarbon fractions, the predominant portions of which exhibit initial boiling points above about 500° F. at atmospheric pressure. Examples of useful process feedstocks include crude oil vacuum distillates from paraffinic or naphthenic crudes, i.e., deasphalted residual oils, the heaviest fractions of catalytic cracking cycle oils, coker distillates and/or thermally cracked oils, heavy vacuum gas oils and the like. These fractions are derived from petroleum crude oils, shale oils, tar sand oils, coal hydrogenation products and the like. Preferred feedstocks include deasphalted petroleum oils that exhibit initial boiling points in the range of from about 930° F. to 1050° F. and a Conradson carbon residue number less than about 3 and gas oils that boil predominantly between about 500° F. and 1050° F. and exhibit viscosities ranging from about 35 to 200 SUS, preferably 40 to 100 SUS at 210° F.

The feedstock preferably has a viscosity index above 0 and most preferably above about 30 by ASTM test method D-2270-86.

The particular solvent which is used in the extraction operation depends upon several considerations, the primary consideration being economics. While there is no requirement that the solvent used in the first extraction be the same as that used in the second extraction step, it is economical that the solvents be the same and this embodiment is preferred for this reason. Any solvent, selective for aromatics, particularly selective for polycyclic aromatics, may be used such as furfural, acetophenone, liquid $SO_2$, acetonitrile, phenol, nitrobenzene, aniline, 2,2-dichlorodiethyl ether, dimethyl sulfoxide, dimethyl formamide, N-methyl-2-pyrrolidone and mixtures thereof. In addition, any of these solvents in combination with an antisolvent such as water, wet solvent, lower alcohols and glycols may be used in the solvent extraction steps. The most preferred antisolvent is water based on cost effectiveness. N-methyl-2-pyrrolidone is the most preferred solvent when it contains between about 0.3 vol % and 10 vol % water based on the solvent mixture, preferably 0.3 vol % to 0.5 vol % water. Solvent dosages of about 75 to 500 vol %, preferably 100 to 300 vol % are used.

In general, the various means customarily utilized in extraction processes to increase the contact area between the oil stock and the solvent can be employed. Thus, the apparatus used in the instant process can comprise a single extraction zone or multiple extraction zones. The equipment employed in the extraction zone is not critical and can comprise rotating disc contactors, countercurrent packed bed extraction columns, countercurrent tray contactors and centrifugal contactors. The operation may be conducted as a batch or continuous operation with the latter being preferred. A continuous countercurrent operation is most preferred. Known techniques for increasing selectivity for aromatics can be employed. Examples of these are the use of small amounts of antisolvents, curing the extract with the solvent, operating at fairly low temperatures sufficient to carry out the extraction objectives, and using low solvent to oil ratios.

The temperature of the extraction and the amount of solvent used are interdependent, and are, in turn, dependent upon the composition of the particular oil stock to be extracted. With this in mind the following extraction process points are noted. First, the extraction temperature is preferably maintained at about 40° F. below the temperature of miscibility of the oil and solvent in order to obtain the desired extraction effect and to conduct a high efficient extraction operation with good yields of oil. The lower temperature limit is controlled in part by the pour point of the dewaxed raffinate product. If the feed has not been dewaxed, then the minimum temperature of the extraction is controlled by the points at which solids appear. If the extraction temperature is too low, the extraction will be too selective and will require compensation, such as additional amounts of solvent and extraction stages. The extraction temperature range is generally between about 100° F. and 250° F., preferably between about 120° F. and 200° F., depending on the oil-solvent miscibility temperature. In the case of the preferred N-methyl-2-pyrrolidone-water solvent, the temperature ranges from about 120° F. to 180° F.

It is noted that high solvent-oil ratios tend to reduce operational efficiency, consume larger quantities of energy and are to be avoided. Thus, for the most part solvent-oil dosages (defined as volume of solvent added per volume of oil times one hundred) range between about 75 and about 500. Particularly preferred ratios range between about 100 to about 300. For feedstocks derived from low lube quality crudes such as heavy vacuum gas oils and deasphalted oils derived from South Louisiana crudes, typical extraction temperatures of 170° F. and 200° F. may be used with solvent to oil dosages of about 150 vol % to 400 vol %.

After the primary solvent extraction the primary raffinate phase is passed from the top of the primary extraction tower. The primary raffinate phase comprises about 10 to 15 vol % extraction solvent which is removed to yield an oil having a viscosity index (VI) within the range of about 75 to 100 and preferably about 85 to 96 after dewaxing to the desired pour point. Primary raffinates with viscosity index (VI) as high as 120 have been produced from high quality paraffinic oil and as low as 10 from high quality naphthene oil. In the case of naphthene oils solvent-to-oil ratio and temperature are more typically adjusted to achieve a polynuclear aromatic content of 3 wt % or less for toxilogical considerations rather than refining to achieve a selected viscosity index (VI).

The primary extract phase comprising an oil richer in aromatics than the feedstock and a major proportion of the extraction solvent is passed from the bottom of the primary extraction tower to a decanter. To assist in effecting the separation in the decanter, primary extract phase is mixed with an antisolvent and cooled. The antisolvent, also known as a solvent modifier is selected from a class of compounds which are characterized as being only slightly soluble in paraffinic mineral oils and which is substantially completely soluble in the extraction solvent. The preferred antisolvent in industrial practice is water. Additional antisolvents include alcohols and glycols. Specific examples of effective antisolvents include glycerine, ethylene glycol, diethylene glycol, formamide, and methyl alcohol.

The primary extract-antisolvent mixture is cooled to a temperature sufficiently lower than the temperature in the primary extraction tower to form two immiscible liquid phases in the decanter wherein separation occurs. Cooling of the primary extract to a temperature 10° F. to 120° F. below the temperature in the bottom of the extraction tower results in the formation of two liquid phases which are separated from one another by gravity in the decanter.

The lower phase, termed secondary extract, contains extraction solvent, antisolvent and oil relatively richer in aromatic content than the primary extract phase. Secondary extract is freed of solvent and used commercially for its aromatic content. For example it is used as a rubber extender oil or for a feedstock to make carbon black. Or, it may be routed to the liquid fuel oil pool. Secondary extract is freed of solvent by conventional processing. For example, it may be processed in a vacuum flash tower, and a steam stripper at a pressure in the range of 0.01 atm to 3 atm and withdrawn as a bottoms product. This bottoms product may optionally be stripped by means of an inert gas at a temperature of 450° F. to 600° F. and pressure of 0.01 atm to 1 atm to remove the last traces of solvent. Such a process to free extract from extraction solvent is described in U.S. Pat. No. 4,294,689 to A. Sequeira, Jr. incorporated herein by reference.

The upper phase, termed secondary raffinate, is so depleted in aromatic compounds that after solvent removal (such as that described in U.S. Pat. No. 4,294,689) it is suitable for fluid catalytic cracker feed in the absence of hydrocracking or other hydrogenation.

The fluid catalytic cracking (FCC) unit operation is one in which a petroleum fraction is catalytically cracked to liquid fuel boiling range products in a fluidized bed of particulate solid catalyst specific for this purpose. Typically a petroleum distillate or residual fractions of crude oils are catalytically cracked to gasoline or a gas oil product as well as gaseous hydrocarbons. Fluid catalytic cracking is carried out in a transfer line reactor in cyclic communication with a catalyst regeneration zone. In the regeneration zone solid products of cracking, generically termed coke, which have deposited on the catalyst are removed by oxidation thereby reactivating catalyst activity.

Catalysts useful in the fluid catalytic cracking unit operation include siliceous inorganic oxides, such as silica alumina, or zeolite-containing cracking catalysts, including crystalline aluminosilicate zeolites associated with a porous refractory matrix, such as clay or the like. Zeolites suitable for these types of catalysts include X type zeolite or Y type zeolite having a low sodium content.

The catalyst is suspended or fluidized in the transfer line reactor by means of a lift gas. Lift gas comprises an inert gas which is available for this purpose. It typically comprises a saturated $C_1$ to $C_4$ hydrocarbon gas such as a refinery fuel gas.

The secondary raffinate is introduced into the fluidized bed at catalytic cracking conditions. This raffinate may be introduced as the sole feedstock. The raffinate may alternatively be blended into a pool of petroleum fractions which are collected for use as fluid catalytic cracking feedstock. Catalytic cracking conditions include a temperature in the range of about 600° F. to about 1050° F., pressure of about 1.25 atm to about 2 atm, a catalyst to hydrocarbon weight ratio of about 3 to 10 and a weight hourly space velocity of about 5 to 200 per hour. At these cracking conditions about 0.5 wt % to 2.5 wt % coke is deposited on the catalyst.

Coke deactivated catalyst is separated from hydrocarbon product and then stripped with steam or inert gas at a temperature of about 750° F. to about 1150° F. to remove volatile components of the coke. The coke deactivated catalyst is then passed to a catalyst regeneration zone, first to a lower dense phase bed of catalyst having a temperature of about 1050° F. to 1300° F. and second to an upper dilute phase bed having a temperature of about 1100° F. to 1350° F. wherein in the presence of excess oxygen, coke is oxidized to carbon monoxide and carbon dioxide. The catalyst, reactivated by the removal of all but about 0.1 wt % coke is passed to a regenerated catalyst standpipe for reuse in the fluid catalytic cracking zone.

It is a characteristic of the fluid catalytic cracking processes that the catalytic cracking zone and the catalyst regeneration zone are heat integrated. The heat required in the cracking zone to maintain reaction temperature is supplied by the oxidation of coke in the regeneration zone. Conversely, the cracking zone is the heat sink for the catalyst regeneration zone. The heat requirements of the one zone are satisfied by the other zone in maintaining steady state. Accordingly feedstocks for the catalytic cracking process are constrained by the relative amount of coke they yield. Specifically, aromatic feedstocks produce relatively large amounts of coke and are therefore useful as fluid catalytic cracking feedstock only after catalytic hydrogenation to reduce the saturation and corresponding coke yield to an amount which permits operation within the process temperature constraints. Those constraints include burning coke from catalyst to produce a coke on regenerated catalyst of 0.1 wt % or less, a transfer line reactor temperature of 600° F. to 1050° F. and a regenerator temperature of 1050° F. to 1350° F.

Accordingly, Applicant has discovered empirically that according to the instant invention, secondary raffinates from paraffinic oils are produced with a viscosity index in the range of 40 to 85 by ASTM D-2270-86. Secondary raffinates produced according to this process are suitable fluid catalytic cracking feedstocks. They may also be blended with other conventional fluid catalytic cracker feedstocks including naphtha, light gas oil, heavy gas oil, residual fractions, reduced crude oils, cycle oils derived from any of these fractions as well as suitable fractions derived from shale oil, tar sands, bitumen oil, synthetic oil, coal hydrogenation and the like.

This invention is shown by way of Example.

EXAMPLE 1

A 300 neutral distillate derived from a South Louisiana crude oil was extracted with N-methyl-2-pyrrolidone (MP). The primary extract was separated by cooling into two fractions, a secondary raffinate and a secondary extract. The process conditions used and test results on the primary raffinate, primary extract, secondary raffinate and secondary extract after solvent removal and dewaxing of the solvent free raffinates are shown below.

| | RUN NUMBER | | | |
|---|---|---|---|---|
| REFINING CONDITIONS | 1-A | 1-B | 1-C | 1-D |
| MP Solvent Dosage Vol % (0.3 Vol % Water) | 245 | 245 | 245 | 245 |
| Extraction Temp., °F. | 180 | 180 | 180 | 180 |
| Extraction Pressure, Atm. | | | | |
| Second Raffinate Separation Temp., °F. | — | 150 | 130 | 110 |
| Yield, | | | | |
| Vol % Primary Raffinate | 58.0 | 58.0 | 58.0 | 58.0 |
| Vol % Secondary Raffinate | 0 | 10.4 | 13.0 | 18.6 |
| Vol % Primary Extract | 42.0 | 0 | 0 | 0 |
| Vol % Secondary Extract | 0 | 31.6 | 29.0 | 23.4 |

| | DISTILLATE FEED | PRIMARY RAFFINATE | SECONDARY RAFFINATE | SECONDARY RAFFINATE | SECONDARY RAFFINATE |
|---|---|---|---|---|---|
| TESTS ON WAXY OILS | | | | | |

-continued

| | | | | | |
|---|---|---|---|---|---|
| Refractive Index @ 70° C. | 1.4810 | 1.4595 | 1.4749 | 1.4745 | 1.4785 |
| API Gravity, °API | 25.1 | 31.1 | 27.0 | 27.2 | 26.3 |
| Flash. COC. °F. | 445 | 440 | 440 | 425 | 440 |
| Vis SUS @ 100° F. | 413 | 239 | 354 | 360 | 383 |
| Pour Point, F. | 95 | — | 85 | 80 | 80 |
| Aniline Point, °F. | — | 220+ | 211 | — | 208 |
| Sulfur, wt % | 0.31 | — | 0.17 | 0.22 | 0.24 |
| TESTS ON DEWAXED OILS | | | | | |
| API Gravity, °API | — | 30.6 | 25.5 | 25.8 | 24.9 |
| Vis SUS @ 100° C. | 485 | 287 | 458 | 460 | 488 |
| Viscosity Index | 67 | 95 | 74 | 70 | 68 |
| Pour Point, °F. | 0 | 0 | 0 | 0 | 0 |
| TESTS ON EXTRACTS | | | | | |
| API Gravity, °API | | 18.0 | 14.2 | 13.2 | 11.0 |
| Flash, COC °F. | | 450 | 470 | 440 | 440 |
| Vis SUS @ 100° F. | | 1160 | 3560 | 4372 | 8070 |
| Aniline Point, °F. | | 161 | 131 | — | — |
| Aromatics, Wt % | | 52.9 | 62.9 | 63.5 | 66.6 |
| Saturates, Wt % | | 39.8 | 27.0 | 24.5 | 17.7 |
| Asphaltenes, Wt % | | 1.1 | 2.4 | 3.6 | 5.7 |
| Polar Aromatics, Wt % | | 6.2 | 7.7 | 8.4 | 10.0 |

Primary extract is too low in aromatics for use as a rubber extender oil. It can be separated into a medium VI secondary raffinate and a secondary extract. It is useful as a rubber extender oil, while at the same time manufacturing a high VI base oil.

A fluid catalytic cracking response was determined for the primary extract from Run 1-A and secondary raffinate from Run 1-D. The results of this study are summarized below.

| FCCU Run No.<br>Feedstock<br>Operating Conditions | 1<br>PRIMARY EXTRACT | 2<br>SECONDARY RAFFINATE |
|---|---|---|
| Inlet Temp., °F. | 600 | 600 |
| Outlet Temp., °F. | 975 | 975 |
| Regeneration Bed Temp., °F. | 1424 | 1348 |
| Gas Oil Conversion, Vol % | 74.6 | 79.1 |
| Total Naphtha Yield, Wt % | 86.7 | 97.4 |

These data show that the secondary raffinate is a better FCCU feedstock than the primary extract.

EXAMPLE 2

A 300 neutral distillate from another South Louisiana crude was N-methyl-2-pyrrolidone (MP) refined and the primary extract separated into a secondary raffinate and a secondary extract by cooling or by cooling with the addition of water to the primary extract leaving the extractor. The results obtained from this study are summarized below.

| REFINING CONDITIONS | RUN NUMBER 2-A | 2-B | 2-C | 2-D |
|---|---|---|---|---|
| MP Solvent Dosage Vol % (0.3 Vol % Water) | 280 | 280 | 280 | 280 |
| Extraction Temp., °F. | 150 | 150 | 150 | 150 |
| Second Raffinate Separation Temp., °F. | — | 130 | 130 | 130 |
| Water Added To Primary Extract, Vol % | 0 | 0 | 3 | 5 |
| Yield, | | | | |
| Vol % Primary Raffinate | 54.4 | 54.4 | 54.4 | 54.4 |
| Vol % Secondary Raffinate | 0 | 7.6 | 19.4 | 25.7 |
| Vol % Primary Extract | 45.6 | 0 | 0 | 0 |
| Vol % Secondary Extract | 0 | 38.0 | 26.2 | 19.9 |

| TESTS ON EXTRACTS | PRIMARY EXTRACT | SECONDARY EXTRACT | SECONDARY EXTRACT | SECONDARY EXTRACT |
|---|---|---|---|---|
| Aromatics, Wt % | 53.6 | 61.0 | 67.5 | 76.7 |
| Saturates, Wt % | 41.4 | 33.5 | 23.6 | 14.7 |
| Asphaltenes, Wt % | 0.1 | 0.1 | 0.3 | 0.4 |
| Polar Aromatics, Wt % | 4.9 | 5.4 | 8.6 | 8.2 |

These data show that water can be used as an antisolvent to effect the separation of higher yield of secondary raffinate and more aromatic extract than is obtainable by the reduction of temperature alone. This technique is particularly useful when it is desirable to manufacture a by-product such as rubber extender oils of less than 20 wt % saturates from highly paraffinic feedstocks which provide high saturate content extracts. It should be noted that the use of an antisolvent such as a highly aromatic hydrocarbon, glycols, alcohols and the like can be used to effect the desired separation. However, water is the preferred antisolvent because it is effective at low concentrations, is cheap, is available in the process and is easily removed by distillation.

| TABLE OF TEST METHODS | |
|---|---|
| Pour Point | ASTM D-97-87 |
| Aniline Point | ASTM D-611-82 |
| Sulfur | ASTM D-2622-87 |
| Viscosity Index (VI) | ASTM D-2270-86 |
| Flash, COC °F. | ASTM D-92-85 |
| API Gravity, °API | ASTM D-287 |

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. In a process for solvent refining a hydrocarbon lubricating oil stock containing aromatic and non-aromatic components with an extraction solvent wherein said lubricating oil stock is contacted with the extraction solvent in a solvent extraction zone at an extraction temperature in the range of 100° F. to 250° F. and a solvent oil dosage in the range of 75 to 500 vol % thereby forming an aromatics-rich primary extract and an aromatics-lean primary raffinate; the improvement comprising:

separating and cooling the primary extract to a temperature 10° F. to 120° F. below said extraction temperature and admixing with about 0.0 vol % to 10 vol % antisolvent in a separation zone thereby forming two phases consisting of a secondary extract phase richer in aromatics and a secondary raffinate phase leaner in aromatics;

separating said secondary raffinate phase and in the absence of hydrogenation passing said secondary raffinate to a fluid catalytic cracking zone at cracking conditions thereby yielding a liquid fuel product.

2. The process of claim 1 wherein the amount of antisolvent is 0.5 vol % to 10 vol %.

3. The process of claim 1 wherein the antisolvent is selected from the group consisting of water, glycols and alcohols.

4. The process of claim 1 wherein the antisolvent is water.

5. The process of claim 1 wherein the extraction solvent is selected from the group consisting of N-methyl-2-pyrrolidone, furfural, phenol and water mixtures thereof.

6. The process of claim 1 wherein the extraction solvent is N-methyl-2-pyrrolidone.

7. The process of claim 1 wherein the extraction solvent is N-methyl-2-pyrrolidone and the antisolvent is water.

8. The process of claim 1 wherein the solvent extraction zone the extraction solvent is in admixture with 0.3 to 10 vol % water.

9. The process of claim 1 wherein the antisolvent is water and wherein in the solvent extraction zone the extraction solvent is in admixture with 0.3 to 0.5 vol % water and wherein in the separation zone admixing is with 3 to 5 vol % water.

10. The process of claim 1 wherein the primary raffinate has a viscosity index of at least 85.

11. The process of claim 1 wherein the primary raffinate has a polynuclear aromatic content of 3 wt % or less.

12. In a process for solvent refining a hydrocarbon based lubricating oil stock containing aromatic and non-aromatic components with an extraction solvent comprising N-methyl-2-pyrrolidone in admixture with 0.3 to 0.5 vol % water wherein said lubricating oil stock is contacted with said extraction solvent in a solvent extraction zone at an extraction temperature in the range of 120° F. to 200° F. and a solvent to oil dosage in the range of 100 to 300 vol % forming an aromatics-rich primary extract and an aromatics-lean primary raffinate of increased viscosity index; the improvement comprising:

separating and cooling the primary extract to a temperature 10° F. to 120° F. below said extraction temperature and admixing 3 vol % to 5 vol % water thereby forming two phases in a separation zone said two phases consisting of a secondary extract phase richer in aromatics and a secondary raffinate phase leaner in aromatics, separating said secondary raffinate phase and, in the absence of hydrogenation passing said secondary raffinate phase to a fluid catalytic cracking zone at cracking conditions thereby yielding a liquid fuel product.

13. In a process for solvent refining a hydrocarbon lubricating oil stock containing aromatic and non-aromatic components with an extraction solvent wherein said lubricating oil stock is contacted with the extraction solvent in a solvent extraction zone at an extraction temperature in the range of 100° F. to 250° F. and a solvent to oil dosage in the range of 75 to 500 vol % thereby forming an aromatics-rich primary extract and an aromatic-lean primary raffinate; the improvement comprising:

separating and cooling the primary extract to a temperature 10° F. to 120° F. below said extraction temperature and admixing with about 0.0 vol % to 10 vol % antisolvent in a separation zone thereby forming two phases consisting of a secondary extract phase richer in aromatics and a secondary raffinate phase leaner in aromatics;

separating said secondary raffinate phase and in the absence of additional aromatic reduction, passing said secondary raffinate to a fluid catalytic cracking zone at cracking conditions thereby yielding a liquid fuel product.

14. The process of claim 13 wherein the amount of antisolvent is 0.5 vol % to 10 vol %.

15. The process of claim 13 wherein the antisolvent is selected from the group consisting of water, glycols and alcohols.

16. The process of claim 13 wherein the antisolvent is water.

17. The process of claim 13 wherein the extraction solvent is selected from the group consisting of N-methyl-2-pyrrolidone, furfural, phenol and water mixtures thereof.

18. The process of claim 13 wherein the extraction solvent is N-methyl-2-pyrrolidone.

19. The process of claim 13 wherein the extraction solvent is N-methyl-2-pyrrolidone and the antisolvent is water.

20. The process of claim 13 wherein the solvent extraction zone the extraction solvent is in admixture with 0.3 to 10 vol % water.

21. The process of claim 13 wherein the antisolvent is water and wherein in the solvent extraction zone the extraction solvent is in admixture with 0.3 to 0.5 vol % water and wherein in the separation zone admixing is with 3 to 5 vol % water.

22. The process of claim 13 wherein the primary raffinate has a viscosity index of at least 85.

23. The process of claim 13 wherein the primary raffinate has a polynuclear aromatic content of 3 wt % or less.

24. In a process for solvent refining a hydrocarbon based lubricating oil stock containing aromatic and non-aromatic components with an extraction solvent comprising N-methyl-2-pyrrolidone in admixture with 0.3 to 0.5 vol % water wherein said lubricating oil stock is contacted with said extraction solvent in a solvent extraction zone at an extraction temperature in the range of 120° F. to 200° F. and a solvent to oil dosage in the range of 100 to 300 vol % forming an aromatics-rich primary extract and an aromatics-lean primary raffinate of increased viscosity index; the improvement comprising:

separating and cooling the primary extract to a temperature 10° F. to 120° F. below said extraction temperature and admixing 3 vol % to 5 vol % water thereby forming two phases in a separation zone and two phases consisting of a secondary extract phase richer in aromatics and a secondary raffinate phase leaner in aromatics, separating said secondary raffinate phase and in the absence of additional aromatic reduction, passing said secondary raffinate phase to a fluid catalytic cracking zone at cracking conditions thereby yielding a liquid fuel product.

* * * * *